US011202469B2

(12) United States Patent
Chen

(10) Patent No.: US 11,202,469 B2
(45) Date of Patent: Dec. 21, 2021

(54) ELECTRONIC CIGARETTE AND POWER SUPPLY APPARATUS

(71) Applicant: SHENZHEN SMOORE TECHNOLOGY LIMITED, Shenzhen (CN)

(72) Inventor: Zhiping Chen, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 119 days.

(21) Appl. No.: 16/617,209

(22) PCT Filed: May 27, 2017

(86) PCT No.: PCT/CN2017/086384
§ 371 (c)(1),
(2) Date: Nov. 26, 2019

(87) PCT Pub. No.: WO2018/218449
PCT Pub. Date: Dec. 6, 2018

(65) Prior Publication Data

US 2021/0137162 A1 May 13, 2021

(51) Int. Cl.
*A24F 13/00* (2006.01)
*A24F 17/00* (2006.01)
(Continued)

(52) U.S. Cl.
CPC ..... *A24F 40/40* (2020.01); *A24F 40/60* (2020.01); *H01R 13/622* (2013.01);
(Continued)

(58) Field of Classification Search
CPC ... A24F 40/40; H01R 13/622; H01R 13/6205; H01R 31/06
(Continued)

(56) References Cited

U.S. PATENT DOCUMENTS 6,174,206 B1 * 1/2001 Yentile ..... H01R 24/542 439/578
7,140,921 B2 * 11/2006 Liu ..... H01R 31/065 439/638
(Continued)

FOREIGN PATENT DOCUMENTS

CN 202941411 U 5/2013
CN 103300480 A 9/2013
(Continued)

OTHER PUBLICATIONS

International Search Report and Written Opinion from International Application No. PCT/CN2017/086384 dated Feb. 26, 2018.

*Primary Examiner* — Abdullah A Riyami
*Assistant Examiner* — Thang H Nguyen
(74) *Attorney, Agent, or Firm* — Marcus S. Simon

(57) ABSTRACT

A power supply device for an electronic cigarette and an electronic cigarette. The power supply device for an electronic cigarette includes a power supply body and an adopter. The power supply body is provided with a receiving portion, the receiving portion is provided with a receiving chamber configured to receive an atomization device and an extending opening for a mouthpiece of the atomization device to extend out, and a bottom portion of the receiving chamber opposite to the extending opening is provided with a socket removably connected to a first connector of the atomization device. Two ends of the adapter is provided with a first adapter and a second adapter respectively, the first adapter is removably connected to the first connector, and the second adapter is removably connected to the socket, such that the first connector and the socket are conducted by the adapter.

16 Claims, 5 Drawing Sheets

(51) Int. Cl.

| | |
|---|---|
| ***A24F 25/00*** | (2006.01) |
| ***A24F 40/40*** | (2020.01) |
| ***A24F 40/60*** | (2020.01) |
| ***H01R 13/62*** | (2006.01) |
| ***H01R 13/622*** | (2006.01) |
| ***H01R 31/06*** | (2006.01) |
| *A24F 40/10* | (2020.01) |

(52) U.S. Cl.
CPC ..... *H01R 13/6205* (2013.01); *H01R 31/06* (2013.01); *A24F 40/10* (2020.01)

(58) Field of Classification Search
USPC ..... 439/638
See application file for complete search history.

(56) References Cited

U.S. PATENT DOCUMENTS

| | | | | |
|---|---|---|---|---|
| 7,351,111 | B2 * | 4/2008 | Cheng | H01R 27/02 439/638 |
| 7,832,645 | B2 * | 11/2010 | Chen | H05K 5/0282 235/492 |
| 8,100,699 | B1 * | 1/2012 | Costello | H01R 12/724 439/65 |
| 8,491,341 | B2 * | 7/2013 | Bower | H01R 24/28 439/638 |
| 8,979,579 | B2 * | 3/2015 | Zhang | G01R 1/0416 439/540.1 |
| 10,104,909 | B2 * | 10/2018 | Han | A24F 13/12 |
| 10,433,584 | B2 * | 10/2019 | Nettenstrom | B65D 25/10 |
| 10,433,585 | B2 * | 10/2019 | Tucker | A24F 40/40 |
| 10,561,803 | B2 * | 2/2020 | Liu | A24F 40/485 |
| 10,874,807 | B2 * | 12/2020 | Liu | A24F 42/00 |
| 2015/0196059 | A1 * | 7/2015 | Liu | A24F 40/40 131/329 |
| 2017/0367406 | A1 * | 12/2017 | Schuler | H01M 50/20 |
| 2018/0007966 | A1 * | 1/2018 | Li | A24F 40/42 |
| 2018/0104214 | A1 * | 4/2018 | Raichman | A61M 15/0065 |
| 2018/0161525 | A1 * | 6/2018 | Liu | A24F 40/40 |
| 2019/0191768 | A1 * | 6/2019 | Qiu | H01M 50/20 |
| 2019/0223506 | A1 * | 7/2019 | Biel | B67B 7/26 |
| 2020/0154776 | A1 * | 5/2020 | Lee | A24F 40/60 |
| 2020/0245694 | A1 * | 8/2020 | Cameron | H05B 1/0291 |
| 2021/0297489 | A1 * | 9/2021 | Woodbine | A24F 40/42 |

FOREIGN PATENT DOCUMENTS

| | | | |
|---|---|---|---|
| CN | 203563689 | U | 4/2014 |
| CN | 204169057 | U | 2/2015 |
| CN | 204232287 | U | 4/2015 |
| CN | 105192893 | A | 12/2015 |
| CN | 204888743 | U | 12/2015 |
| CN | 205233471 | U | 5/2016 |
| CN | 206808681 | U | 12/2017 |
| KR | 20130000596 | A | 1/2013 |
| KR | 20130106009 | A | 9/2013 |

* cited by examiner

ELECTRONIC CIGARETTE AND POWER SUPPLY APPARATUS

CROSS-REFERENCE TO RELATED APPLICATIONS

This application is a U.S. National Stage Application of PCT International Application No. PCT/CN2017/086384 filed on May 27, 2017, the contents of which are incorporated herein, in their entirety, by reference.

TECHNICAL FIELD

The present disclosure relates to a cigarette substitute, and more specifically, to an electronic cigarette and a power supply device.

BACKGROUND

With the development of electronic cigarette, there are more and more kinds and shapes of electronic cigarette products. An existing electronic cigarette includes a power supply device and an atomizer with a mouthpiece. The power supply device has an receiving chamber for housing a part of the atomizer in the receiving chamber and exposing the mouthpiece out of the receiving chamber for easy use by the user.

However, because the receiving chamber has a certain depth, when some atomization devices of shorter length are mounted in the receiving chamber, the mouthpiece of the atomizer cannot be exposed out of the receiving chamber, or only a small part of the mouthpiece can be exposed out of the receiving chamber, which is difficult for the user to use.

Therefore, it is very necessary to provide a new electronic cigarette and electronic cigarette accessories to facilitate the user's use.

Technical Problem

The technical problem to be addressed is to provide an electronic cigarette and a power supply device.

SUMMARY

The technical solution to address the technical problem proposed by the present disclosure is to provide a power supply device for an electronic cigarette including a power supply body and an adopter.

The power supply body is provided with a receiving portion, the receiving portion is provided with a receiving chamber configured to receive an atomization device and an extending opening for a mouthpiece of the atomization device to extend out, and a bottom portion of the receiving chamber opposite to the extending opening is provided with a socket removably connected to a first connector of the atomization device.

Two ends of the adapter is provided with a first adapter and a second adapter respectively, the first adapter is removably connected to the first connector, and the second adapter is removably connected to the socket, such that the first connector and the socket are conducted by the adapter.

Preferably, the adapter is rotatably engaged with the socket about an axis, and an axial position thereof remaining unchanged during rotation.

Preferably, the first connector includes a screw connector engaged with the socket, the first adapter is provided with a first screw hole threadedly engaged with the screw connector; and the socket is provided with a second screw hole threadedly engaged with the screw connector.

Preferably, the second adapter is provided with a plugging connector configured to be plugged into the second screw hole.

Preferably, the adapter is magnetically connected to the socket.

Preferably, the adapter includes a cylindrical housing and a screw socket, a magnet, and a pole pin located in the cylindrical housing, the magnet is located at an end of the screw socket corresponding to the socket;

the pole pin is axially plugged on the screw socket, such that both ends of the pole pin can be conducted with a pole of the first connector and a pole of the socket, respectively;

an inner ring shape of the cylindrical housing corresponding to an outer ring shape of the socket, so as to be sleeved outside the socket, the screw socket being conducted with the cylindrical housing and is insulated from the pole pin, such that the screw socket is conducted with the other pole of the first connector and the other pole of the socket, respectively.

Preferably, a sidewall of the power supply body is provided with an indicator light, the indicator light and an exposed part of the atomization device mounted on the power supply body is located on the same side of the power supply body.

Preferably, a sidewall of the receiving chamber is provided with an opening penetrating to an outer side surface of the receiving portion.

Preferably, the power supply body includes a flat power source, the receiving portion is located on a side surface of an outer ring of the power source and is arranged extending in a longitudinal direction of the side surface;

a thickness of the receiving portion is greater than a thickness of the power source, and the opening and a front or rear surface of the power source are located on the same side.

Preferably, a width of the opening corresponds to a diameter of the atomization device, thus allowing the atomization device and the adaptor to be laterally latched into the opening.

An electronic cigarette, including a power supply device as described above, and an atomization device removably mounted in the receiving chamber, and the first connector and the socket are correspondingly connected and conducted.

TECHNICAL EFFECT

Implementing the electronic cigarette and power supply device of the present disclosure has the following beneficial effects: the power supply device of the present disclosure uses the adaptor, when the length of the atomization device is relatively short, the adaptor can be added to the first connector, such that the mouthpiece can extend out from the receiving chamber through the extending opening after the atomization device is mounted to the power supply device, such that the mouthpiece can be easily exposed and facilitate the use.

BRIEF DESCRIPTION OF THE DRAWINGS

The disclosure will be further described in the following with reference to the accompanying drawings, in which.

DETAILED DESCRIPTION OF THE EMBODIMENTS

In order to have a clearer understanding of the technical features, objects and effects of the present disclosure, the specific embodiments of the present disclosure are described in detail with reference to the accompanying drawings.

Figure 1:
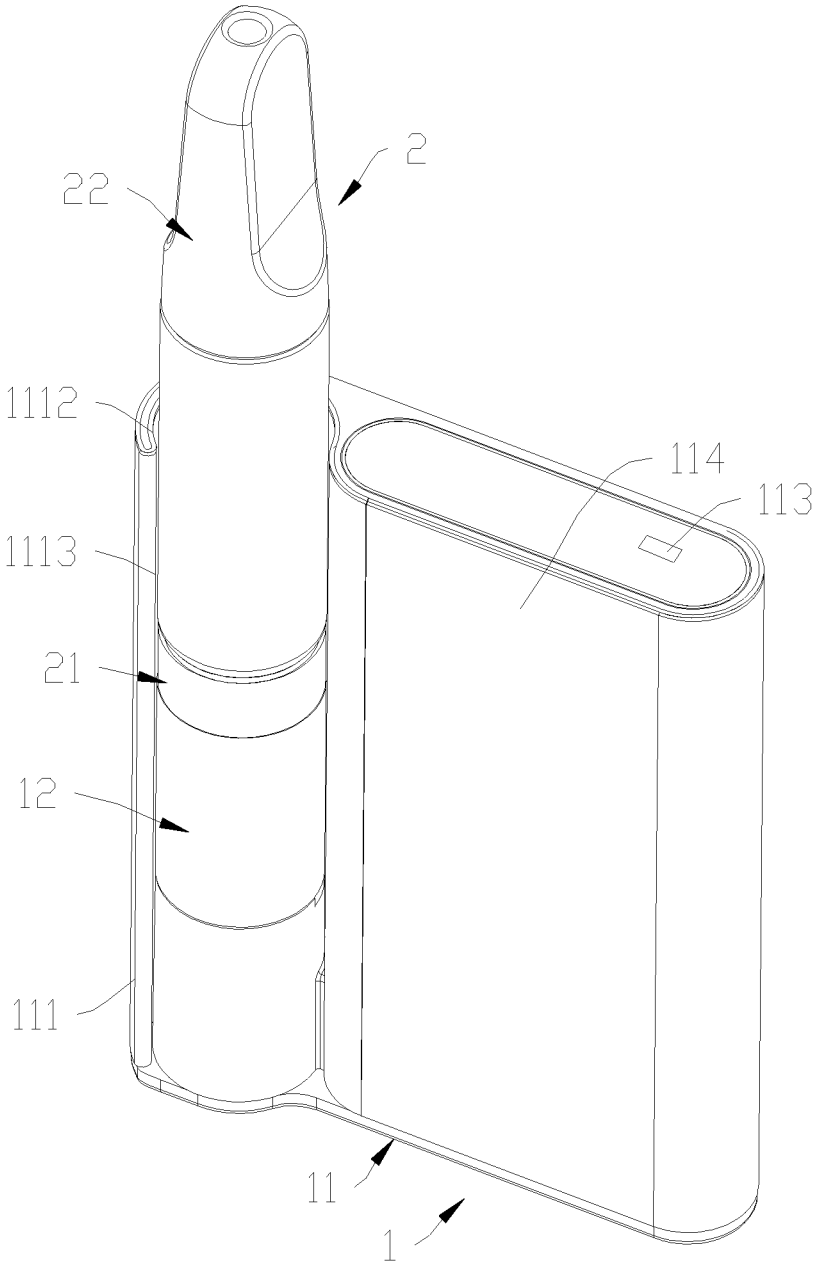
FIG. 1 is a schematic perspective view of an electronic cigarette when a power supply device and an atomization device are assembled according to an embodiment of the present disclosure.

As shown in FIG. 1, an electronic cigarette in a preferred embodiment of the present disclosure includes a power supply device 1 and an atomization device 2 removably mounted on the power supply device 1. The power supply device 1 supplies power for the atomization device 2, such that the atomization device 2 heats atomizing liquid for user to inhale.

Figure 2:
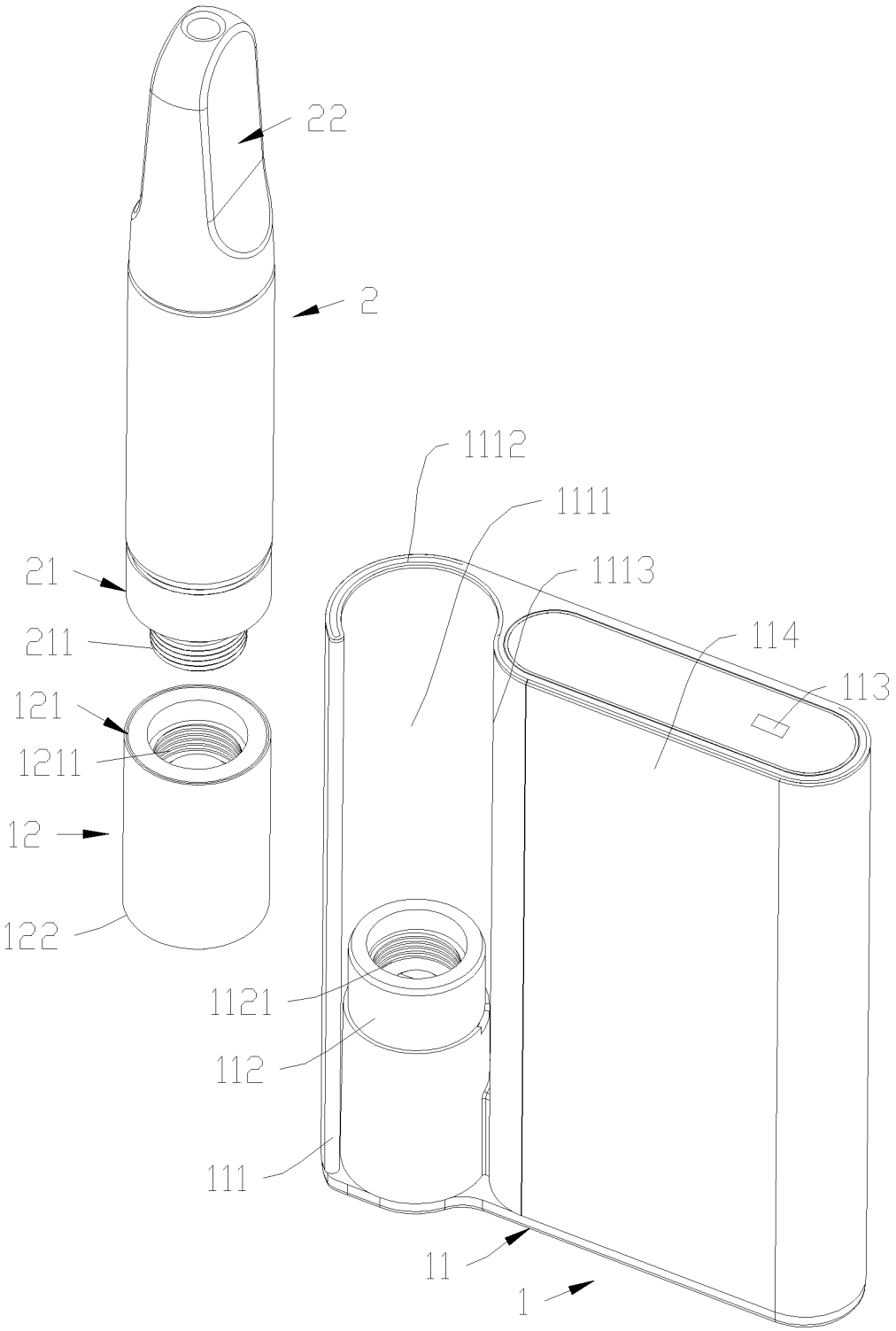
FIG. 2 is a schematic perspective view of the electronic cigarette of FIG. 1 when the power supply device and atomization device are disassembled.

As shown in company with FIGS. 1 and 2, the power supply device 1 includes a power supply body 11 and an adaptor 12. The power supply body 11 is provided with a receiving portion 111. The receiving portion 111 is provided with a receiving chamber 1111 configured to receive an atomization device 2 and an extending opening 1112 for a mouthpiece 22 of the atomization device 2 to extend out.

A bottom portion of the receiving chamber 1111 opposite to the extending opening 1112 is provided with a socket 112 removably connected to a first connector 21 of the atomization device 2. Typically, after the atomization device 2 is mounted to the power supply device 1, the socket 112 and the first connector 21 are conducted.

If the length of the atomization device 2 is long enough, the mouthpiece 22 can extend out of the receiving chamber 1111 through the extending opening 1112 and be nipped by the user. If the length of the atomization device 2 is short, the adapter 12 needs to be added to the first connector 21, such that the mouthpiece 22 can extend out of the receiving chamber 1111 through the extending opening 1112 after the atomization device 2 is mounted.

In some embodiments, two ends of the adapter 12 is provided with a first adapter 121 and a second adapter 122 respectively. The first adapter 121 is removably connected to the first connector 21, and the second adapter 122 is removably connected to the socket 112, such that the first connector 21 and the socket 112 are conducted by the adapter 12.

The introduction of the adapter 12 will not affect the power supply device 1 supplying power to the atomization device 2, and allow the mouthpiece 22 to extend out of the receiving chamber 1111 to facilitate the use of the user.

Further, the adapter 12 is rotatably engaged with the socket 112 about an axis, and an axial position thereof remaining unchanged during rotation. When the mouthpiece 22 is comfortably nipped by the user only at a specific angle, the angle of rotation of the mouthpiece 22 is adjusted by rotating the atomization device 2 and the adapter 12, thus facilitate nipping by the user. If the mouthpiece 22 can be comfortably nipped by the user at any angle, the adapter 12 may not rotate.

Figure 3:
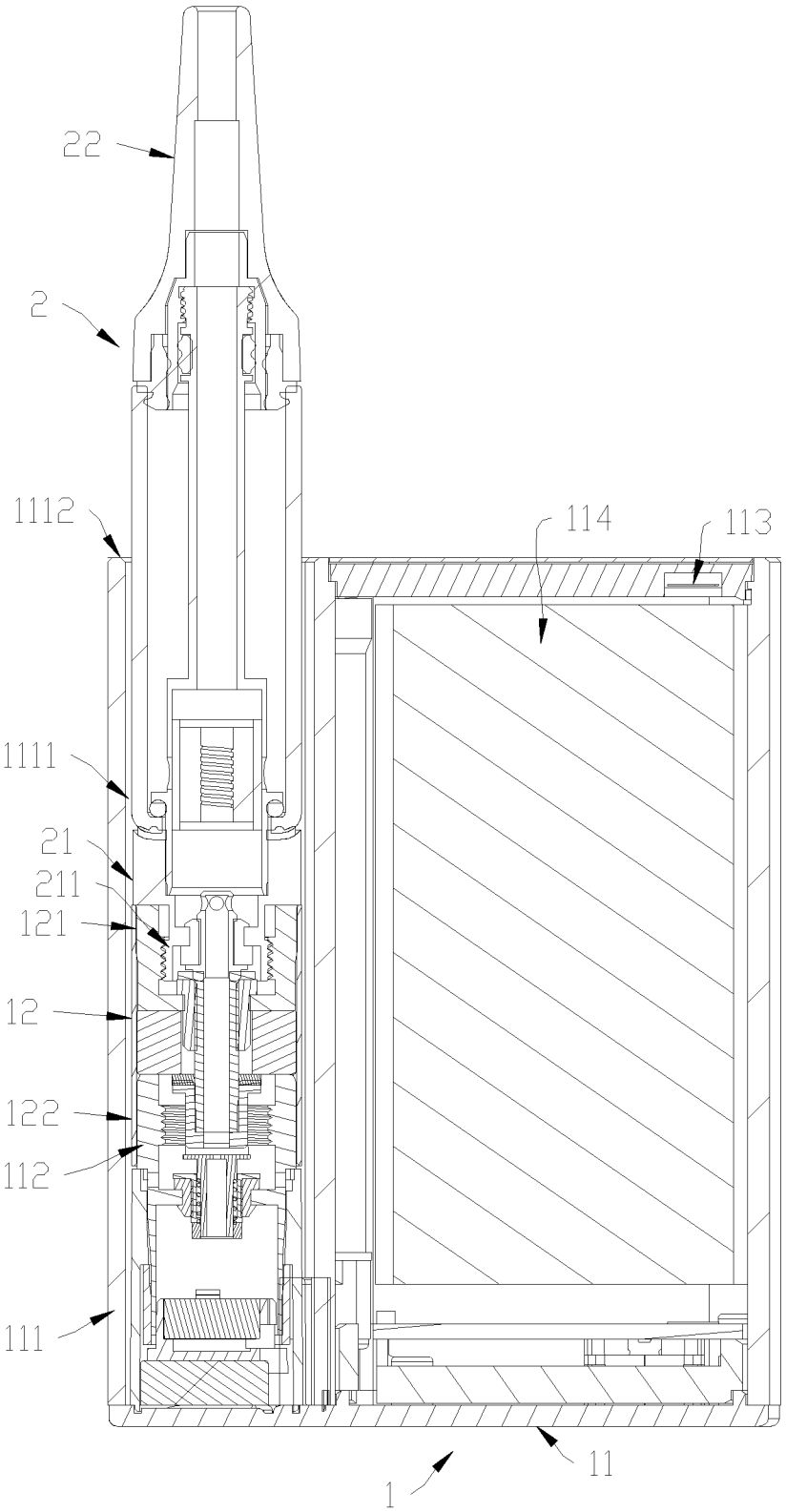
FIG. 3 is a sectional view of the electronic cigarette of FIG. 1.
Figure 4:
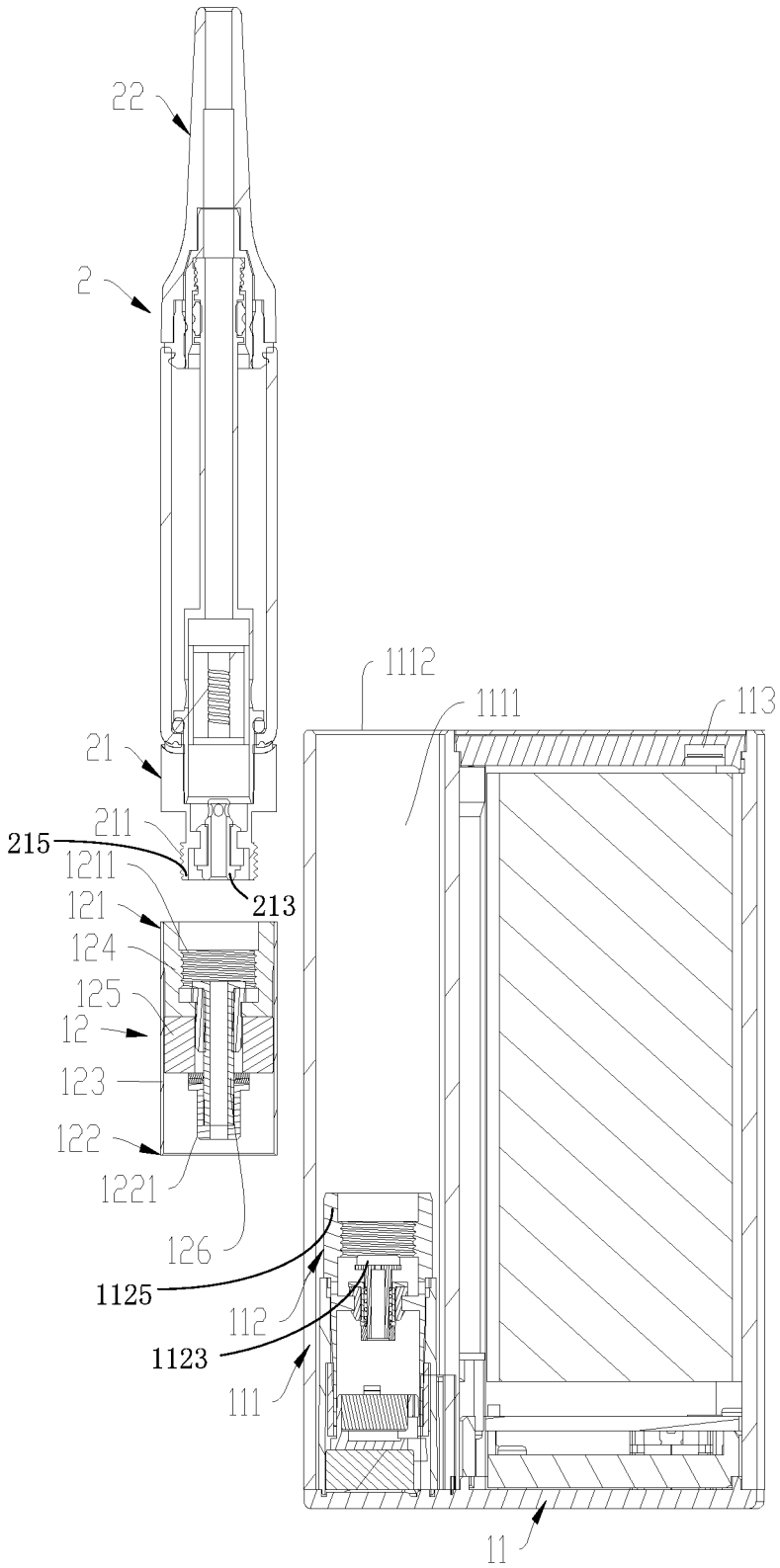
FIG. 4 is a sectional view of the electronic cigarette of FIG. 3 when the power supply device and atomization device are disassembled.

As shown in company with FIGS. 2 to 4, the first connector 21 includes a screw connector 211 engaged with the socket 112, and the socket 112 is provided with a second screw hole 1121 threadedly engaged with the screw connector 211. Further, for universal compatibility, the first adapter 121 is provided with a first screw hole 1211 threadedly engaged with the screw connector 211, such that the first connector 21 and the first adapter 121 are removably assembled.

Further, the second adapter 122 is provided with a plugging connector 1221 configured to be plugged into the second screw hole 1121, such that the adapter 12 can rotate about the axis after being mounted to the socket 112. In other embodiments, the second adapter 122 may also be engaged with the socket 112.

Preferably, the adapter 12 is magnetically connected to the socket 112. The adapter 12 is connected to the socket 112 using magnetism, such that the disassembly and positioning become more convenient, and the rotation direction of the adapter 12 is easily adjusted.

Figure 5:
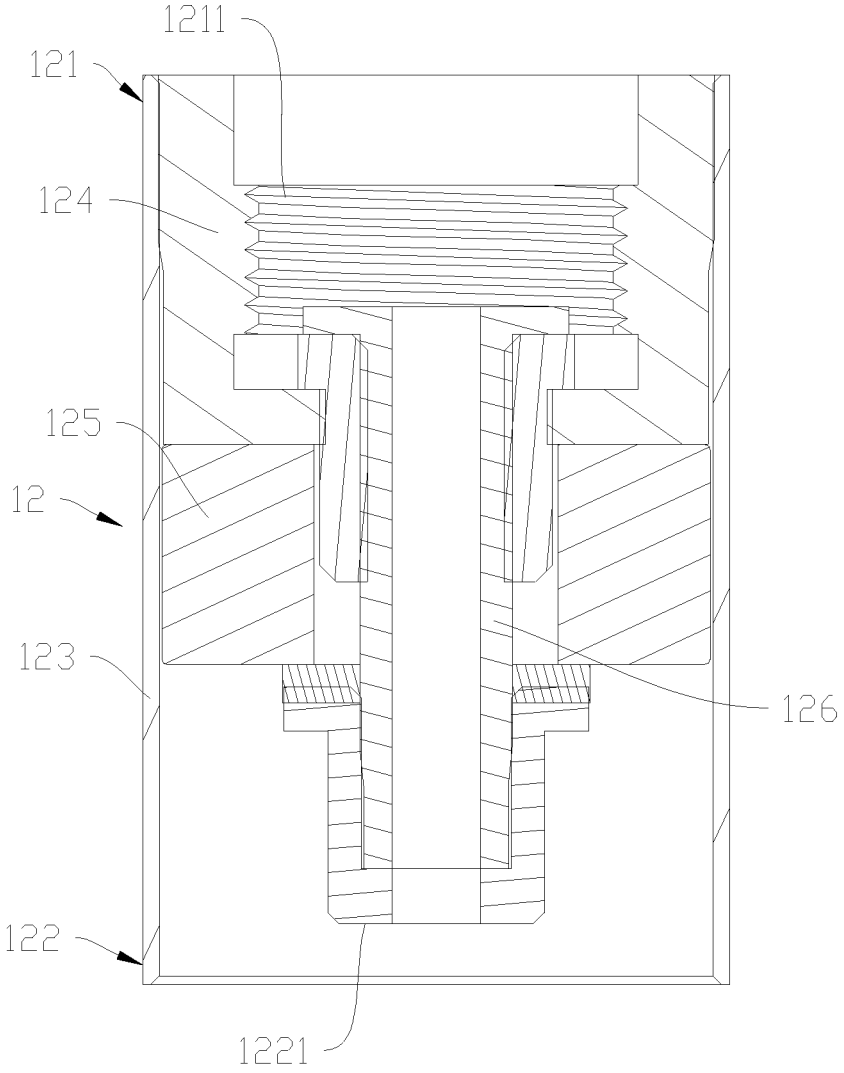
FIG. 5 is a sectional view of an adapter of FIG. 4.

Referring again to FIG. 5, in some embodiments, the adapter 12 includes a cylindrical housing 123 and a screw socket 124, a magnet 125, and a pole pin 126 located in the cylindrical housing 123. The magnet 125 is located at an end of the screw socket 124 corresponding to the socket 112 to facilitate absorption with the socket 112.

The pole pin 126 is axially plugged on the screw socket 124, such that both ends of the pole pin 126 can be conducted to a pole 213 of the first connector 21 and a pole 1123 of the socket 112, respectively.

An inner ring shape of the cylindrical housing 123 corresponds to an outer ring shape of the socket 112, so as to be sleeved outside the socket 112 to facilitate positioning and mounting with the socket 112. The screw socket 124 is conducted with the cylindrical housing 123 and is insulated from the pole pin 126, such that the screw socket 124 is conducted with the other pole 215 of the first connector 21 and the other pole 1125 of the socket 112, respectively.

In some embodiments, a sidewall of the power supply body 11 is provided with an indicator light 113. The indicator light 113 and an exposed part of the atomization device 2 mounted on the power supply body 11 are located on the same side of the power supply body 11, in other words, the indicator light 113 and the mouthpiece 22 of the atomization device 2 are located on a same side. When the user nips the mouthpiece 22, the eyes can see the status of the indicator light 113. The indicator 113 may be a power indicator 113 of the power supply body 11, or may be an indicator 113 showing a turn on/off state the power supply body 11.

Further, as shown in FIGS. 1 and 2, a sidewall of the receiving chamber 1111 is provided with an opening 1113 penetrating to an outer side surface of the receiving portion 111. The user can see the mounting position and the mounting state of the adapter 12 and the atomization device 2 from the opening 1113, so as to ensure that the mounting is in place and the gas inside the receiving chamber 1111 is discharged. Typically, the opening 1113 extends from the extending opening 1112 to the bottom of the receiving chamber 1111.

In some embodiments, the power supply body 11 includes a flat power source 114, and the receiving portion 111 is located on a side surface of an outer ring of the power source 114 and extends in a longitudinal direction of the side surface. A thickness of the receiving portion 111 is greater than a thickness of the power source 114, and the opening 1113 and a front or a rear surface of the power source 114 are located on the same side. Due to the opening 1113, the space occupied by the receiving portion 111 in the thickness direction of the power source 114 can be appropriately reduced.

Preferably, a width of the opening 1113 corresponds to a diameter of the atomization device 2 and the adapter 12, thus allowing the atomization device 2 and the adaptor 12 to be laterally latched into the opening 1113. When the receiving portion 111 is easily deformed to enlarge the opening 1113, the width of the opening 1113 may be the same as or slightly less than the diameter of the atomization device 2 and the adapter 12. When the receiving portion 111 is not vulnerable to deformation, the width of the opening 1113 is larger than the diameter of the atomization device 2 and the adapter 12.

Further, a side of the opening 1113 corresponds to an edge position of the battery in which the receiving portion 111 is located, such that the position of the opening 1113 is adjacent to a front side or a rear side of the battery.

It is understood that the above-mentioned technical features may be used in any combination without limitation.

The foregoing descriptions are merely embodiments of the present disclosure, and are not intended to limit the scope of the present disclosure. Any equivalent structural or equivalent process transformation that is made by using the contents of the specification and accompanying drawings of the present disclosure, or that is directly or indirectly applied in other related technical fields, are included within the protection scope of the present disclosure.

What is claimed is:

1. A power supply device for an electronic cigarette, the power supply device comprising:

a power supply body provided with a receiving portion, the receiving portion being provided with a receiving chamber configured to receive an atomization device and an extending opening for a mouthpiece of the atomization device to extend out, and a bottom portion of the receiving chamber opposite to the extending opening being provided with a socket removably connected to a first connector of the atomization device; and an adapter, two ends of the adapter being provided with a first end adapter and a second end adapter respectively, the first end adapter being removably connected to the first connector, and the second end adapter being removably connected to the socket, such that the first connector and the socket are conducted by the adapter;

wherein the adapter is magnetically connected to the socket;

wherein the adapter comprises a cylindrical housing and a screw socket, a magnet, and a pole pin located in the cylindrical housing, the magnet being located at an end of the screw socket corresponding to the socket;

the pole pin is axially plugged on the screw socket, such that both ends of the pole pin can be conducted with a pole of the first connector and a pole of the socket, respectively;

an inner ring shape of the cylindrical housing corresponding to an outer ring shape of the socket, so as to be sleeved outside the socket, the screw socket being conducted with the cylindrical housing and being insulated from the pole pin, such that the screw socket being conducted with the other pole of the first connector and the other pole of the socket, respectively.

2. The power supply device according to claim 1, wherein the adapter is rotatably engaged with the socket about an axis, and an axial position thereof remaining unchanged during rotation.

3. The power supply device according to claim 1, wherein the first connector comprises a screw connector engaged with the socket, the first adapter being provided with a first screw hole threadedly engaged with the screw connector; and the socket being provided with a second screw hole threadedly engaged with the screw connector.

4. The power supply device according to claim 3, wherein the second end adapter is provided with a plugging connector configured to be plugged into the second screw hole.

5. The power supply device according to claim 1, wherein a sidewall of the power supply body is provided with an indicator light, the indicator light and an exposed part of the atomization device mounted on the power supply body being located on the same side of the power supply body.

6. The power supply device according to claim 1, wherein a sidewall of the receiving chamber is provided with an opening penetrating to an outer side surface of the receiving portion.

7. The power supply device according to claim 6, wherein the power supply body comprises a flat power source, the receiving portion being located on a side surface of an outer ring of the power source and being arranged extending in a longitudinal direction of the side surface;

a thickness of the receiving portion being greater than a thickness of the power source, and the opening and a front or a rear surface of the power source being located on the same side.

8. The power supply device according to claim 6, wherein a width of the opening corresponds to a diameter of the atomization device and the adaptor, thus allowing the atomization device and the adaptor to be laterally latched into the opening.

9. An electronic cigarette, comprising a power supply device and an atomization device removably mounted in the receiving chamber, and the first connector and the socket being correspondingly connected and conducted;

the power supply device comprising:

a power supply body provided with a receiving portion, the receiving portion being provided with a receiving chamber configured to receive an atomization device and an extending opening for a mouthpiece of the atomization device to extend out, and a bottom portion of the receiving chamber opposite to the extending opening being provided with a socket removably connected to a first connector of the atomization device; and an adapter, two ends of the adapter being provided with a first end adapter and a second end adapter respectively, the first end adapter being removably connected to the first connector, and the second end adapter being removably connected to the socket, such that the first connector and the socket are conducted by the adapter;

wherein the adapter is magnetically connected to the socket;

wherein the adapter comprises a cylindrical housing and a screw socket, a magnet, and a pole pin located in the cylindrical housing, the magnet being located at an end of the screw socket corresponding to the socket;

the pole pin is axially plugged on the screw socket, such that both ends of the pole pin can be conducted with a pole of the first connector and a pole of the socket, respectively;

an inner ring shape of the cylindrical housing corresponding to an outer ring shape of the socket, so as to be sleeved outside the socket, the screw socket being conducted with the cylindrical housing and being insulated from the pole pin, such that the screw socket being conducted with the other pole of the first connector and the other pole of the socket, respectively.

10. The electronic cigarette according to claim 9, wherein the adapter is rotatably engaged with the socket about an axis, and an axial position thereof remaining unchanged during rotation.

11. The electronic cigarette according to claim 9, wherein the first connector comprises a screw connector engaged with the socket, the first end adapter being provided with a first screw hole threadedly engaged with the screw connector; and the socket being provided with a second screw hole threadedly engaged with the screw connector.

12. The electronic cigarette according to claim 11, wherein the second end adapter is provided with a plugging connector configured to be plugged into the second screw hole.

13. The electronic cigarette according to claim 9, wherein a sidewall of the power supply body is provided with an indicator light, the indicator light and an exposed part of the atomization device mounted on the power supply body being located on the same side of the power supply body.

14. The electronic cigarette according to claim 9, wherein a sidewall of the receiving chamber is provided with an opening penetrating to an outer side surface of the receiving portion.

15. The electronic cigarette according to claim 14, wherein the power supply body comprises a flat power source, the receiving portion being located on a side surface of an outer ring of the power source and being arranged extending in a longitudinal direction of the side surface;

a thickness of the receiving portion being greater than a thickness of the power source, and the opening and a front or a rear surface of the power source being located on the same side.

16. The electronic cigarette according to claim 14, wherein a width of the opening corresponds to a diameter of the atomization device and the adaptor, thus allowing the atomization device and the adaptor to be laterally latched into the opening.

* * * * *